US006481712B1

(12) United States Patent
Yap

(10) Patent No.: US 6,481,712 B1
(45) Date of Patent: Nov. 19, 2002

(54) APPARATUS FOR PREVENTING LEAD TO TRAIL EDGE COLLISION OF MAILPIECES IN A SORTER

(75) Inventor: Anthony E. Yap, Danbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 16 days.

(21) Appl. No.: 09/870,885

(22) Filed: May 31, 2001

(51) Int. Cl.[7] ..... B65H 39/10

(52) U.S. Cl. ..... 271/303; 271/305; 271/177; 271/215

(58) Field of Search ..... 271/303, 305, 271/177, 215, 214, 903

(56) References Cited

U.S. PATENT DOCUMENTS

| | | | | | |
|---|---|---|---|---|---|
| 4,441,702 | A | * | 4/1984 | Nagel et al. | 271/177 |
| 4,509,739 | A | * | 4/1985 | Kurokawa | 271/215 |
| 4,518,160 | A | * | 5/1985 | Lambrechts et al. | 271/214 |
| 4,640,505 | A | * | 2/1987 | Placke et al. | 271/177 |
| 4,662,626 | A | * | 5/1987 | Shores et al. | 271/305 |
| 5,199,700 | A | * | 4/1993 | Fairey et al. | 271/177 |
| RE34,330 | E | | 8/1993 | Daboub | |
| 5,411,250 | A | | 5/1995 | Belec et al. | |
| 5,417,414 | A | | 5/1995 | Belec et al. | |
| 5,419,440 | A | | 5/1995 | Picoult | |
| 5,429,249 | A | | 7/1995 | Belec et al. | 209/584 |
| 5,960,963 | A | | 10/1999 | Chodack et al. | |
| 5,971,161 | A | | 10/1999 | Branecky et al. | |
| 6,024,359 | A | * | 2/2000 | Hutson | 271/305 |
| 6,065,746 | A | | 5/2000 | Tranquilla | |

* cited by examiner

*Primary Examiner*—H. Grant Skaggs
(74) *Attorney, Agent, or Firm*—Michael J. Cummings; Angelo N. Chaclas

(57) ABSTRACT

The present invention concerns a mailpiece sorting and stacking apparatus. The sorting and stacking apparatus has a series of stacking bins. Each stacking bin is designed to include a set of kicker fingers that engage the trailing ends of the mailpieces traveling towards a stop registration wall in each stacking bin. The stop registration wall in combination with the spring force exerted by the kicker fingers against the trailing ends of the mailpiece cause the end of each mailpiece to engage the outside surface of a pressure mailpiece conveying roller. The pressure mailpiece conveying roller is part of the conveying roller assembly leading to the stacking bin. The periphery of the pressure mailpiece conveying roller along with the deflection force against the trailing end of each mailpiece caused by the kicker fingers causes each mailpiece to stack against a pressure paddle inside the stacking bin.

16 Claims, 9 Drawing Sheets

APPARATUS FOR PREVENTING LEAD TO TRAIL EDGE COLLISION OF MAILPIECES IN A SORTER

FIELD OF THE INVENTION

The present invention relates generally to sorting equipment for flat articles. More particularly it relates to the apparatus for sorting mailpieces and envelopes into a sorting bin or stacking module that is located at the output side of an inserting machine. The invention is directed to providing a mechanism that insures the letter mail or mailpieces are properly aligned against the sorter bin pressure plate.

BACKGROUND OF THE INVENTION

Throughout the history of mail delivery, there has been a gradual evolution whereby the post office and posts encourage mailers to prepare their mail for efficient operation. This means there should be less effort required on the part of the posts or the post offices for processing such mail. An incentive for doing this meant that mailers have to provide faster mail delivery through the use of postal discounts that are available to the mailers. The level of discount typically is based on the number of criteria met by the mailer. For example, in order to maximize such postage discounts, the post office requires that high volume mailers presort the mailpieces, apply a Zip+4 bar code to each mailpiece, and package their mail into postal trays.

Previously, large volume mailers have performed the sorting process on sorting equipment that is set up to process and sort the mail. However the traying process within that equipment is still performed manually. Smaller volume mailers may perform both the sorting and traying processes manually. Clearly such manual traying is not efficient for large volume mailers. As described in commonly assigned U.S. Pat. No. 5,429,249 to Belec et al., this drawback was overcome by the direct interface of a multi-bin-sorting device with an inserter system. This inserter system performs automated sorting of mailpieces in accordance with predetermined postal discount requirements. Essentially, the system consists of an inserter for assembling the mailpieces and a sorter coupled to the inserter for automatically sorting and traying the mailpieces. The sorter includes a sorter controller and a plurality of on-edge sorting bins. The system also includes means for communicating mailpiece data and configuration data to the sorter controller. The sorter controller controls the sorting of mailpieces received from the inserter into sort groups according to postal discount requirements.

Occasionally, there are envelope jamming issues in sortation devices and one way to solve this is described in U.S. Pat. No. 4,718,660 to Daboub. In order to help overcome these jamming issues, an anti-jamming mechanism may be employed, such as an anti-jamming kicker. The kicker gate, when actuated, aligns with the actuated gate of a tray to allow smooth entry of a mailpiece from a transport of the inserter system into a tray of the sorting device. Upon de-actuation, the kicker gate returns to its original position thereby "kicking" the tail of the mailpiece inwardly into the tray and away from the entry area of the tray. Such a kicker-gate mechanism is described in the aforementioned Daboub patent. But, even though such kicker gate devices have been utilized in the prior art, those kinds of devices have some deficiencies. For example, an occasional drawback is seen wherein the kicking gate device will damaged a mailpiece through its "kicking" action against a mailpiece.

Additionally, this anti-jamming mechanism is complex and expensive to implement because it requires an exact timing scheme for actuation of the kicker gate.

Therefore the present invention was conceived in order to provide a sorting device that can be implemented at the output end on an inserting system without suffering from any of the aforementioned drawbacks. The present invention includes a simplified mechanism for preventing jamming of mailpieces that are conveyed into individual sorting bins of the sorting device. The present invention is deemed to be pertinent to the problem of stacking mailpieces of all thickness' that are normally processed in an inserting machine. The device described herein provides a way to insure that thin and thick mailpieces are satisfactorily transferred into the stacking bin without jamming or otherwise damaging them.

SUMMARY

The present invention relates to a sorting apparatus for sorting mailpieces into at least one stacking compartments. The sorter has a transport apparatus that conveys the mailpieces along a transport path in the sorter, and a gating mechanism that selectively operates in two modes. The first mode diverts a mailpiece to a first stacking compartment, and a second mode that permits additional mailpieces to continue along the transport path towards other stacking compartments. The apparatus includes a transport frame having a series of structural guide members located between each stacking compartment. There is a driving nip located in the input side of the stacking compartment formed between a driven roller and an idler roller. There is a stacking assembly included with a mailpiece registration wall and a stack of at least two pressure elements (other wise known as "kicker element fingers or kicker fingers") that are interposed with a segmented portion of the idler roller at the input side of the stacker. The kicker fingers are interfaced with the structural guide members in the transport track to avoid potential injury to the operator or damage to the kicker fingers themselves.

BRIEF DESCRIPTION OF THE DRAWINGS

The above background and brief description of the advantages of the present invention will be apparent upon consideration of the following detailed description when taken in conjunction with accompanying drawings. In the accompanying drawings, like reference characters refer to like parts throughout, and in which.

The above background and brief description of the advantages of the present invention will be apparent upon consideration of the following detailed description when taken in conjunction with accompanying drawings. In the accompanying drawings, like reference characters refer to like parts throughout, and in which.

DETAILED DESCRIPTION OF THE INVENTION

Figure 1:
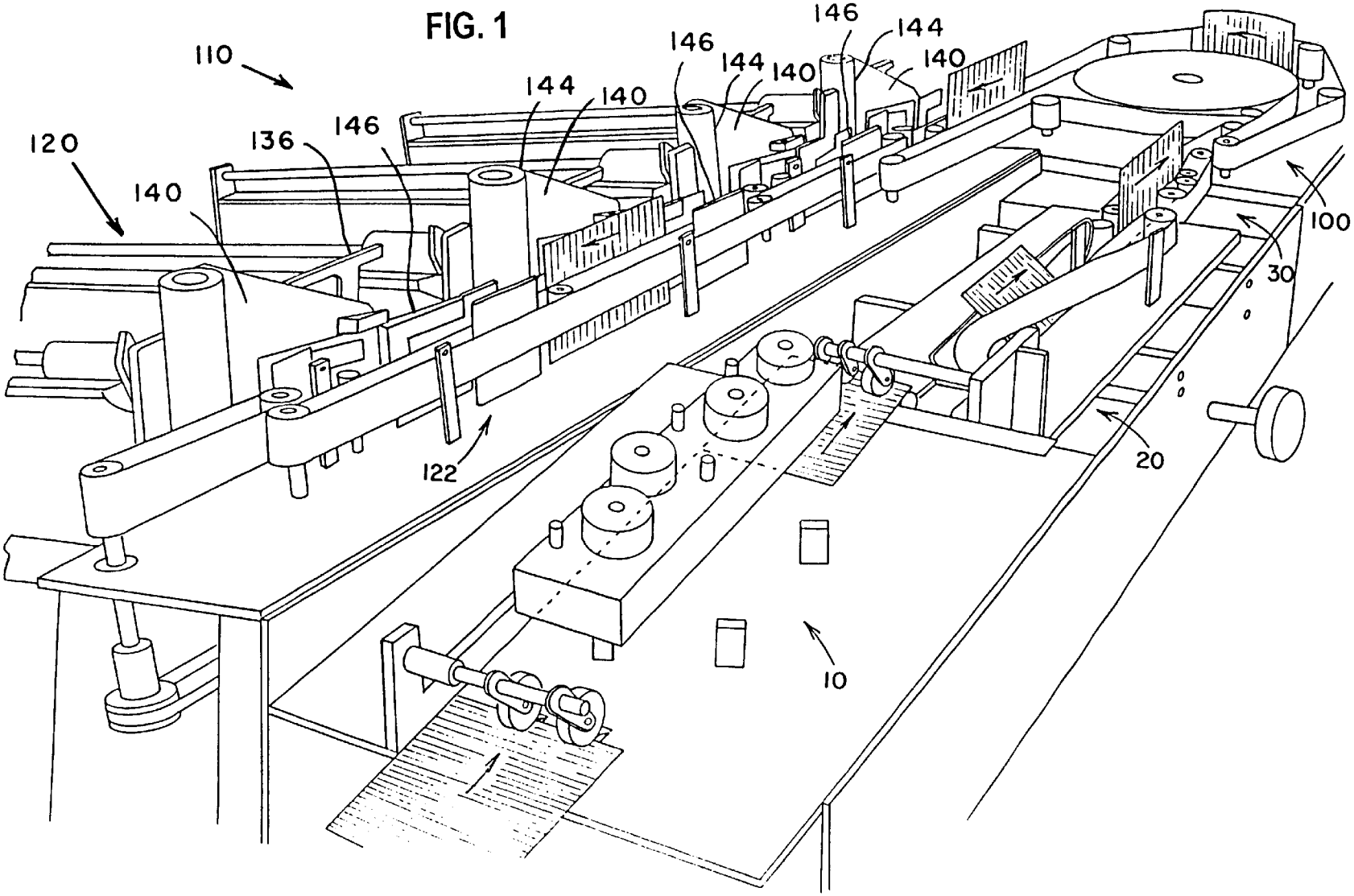
FIG. 1 is a perspective view of apparatus including the sorter where the present invention is utilized.

In describing the present invention, reference is made to the drawings, wherein there is seen in FIG. 1 a series of modules that are connected to perform on-edge stacking of mailpieces assembled in an inserter or other mail finishing equipment. A top-edge alignment module 10 is connected to the output end of an inserter (not shown). Module 10 receives mailpieces from the inserter in a horizontal orientation, maintains top-edge registration of the mailpieces and delivers the mailpieces to a turn-up and alignment module 20 which is coupled to the output end of alignment module 10. Turn-up and alignment module 20 is adjustably positioned to obtain bottom-edge registration of the mailpieces while turning the mailpieces 90 degrees to a vertical orientation. Coupled to the exit of turn-up and alignment module 20 is a stationary vertical transport 30, which transports the mailpieces to a rotating drum transport 100. Drum transport 100 is a vertical transport that moves the mailpieces via it's rotating movement along a U-shaped path to a stacker module 110. A more detailed description of turn-up and alignment module 20 and the transporting of the mailpieces from the inserter to stacker 110 are disclosed in commonly assigned U.S. Pat. Nos. 5,368,283, 5,411,250 and 5,449,159, all of which are hereby incorporated by reference.

Figure 2:
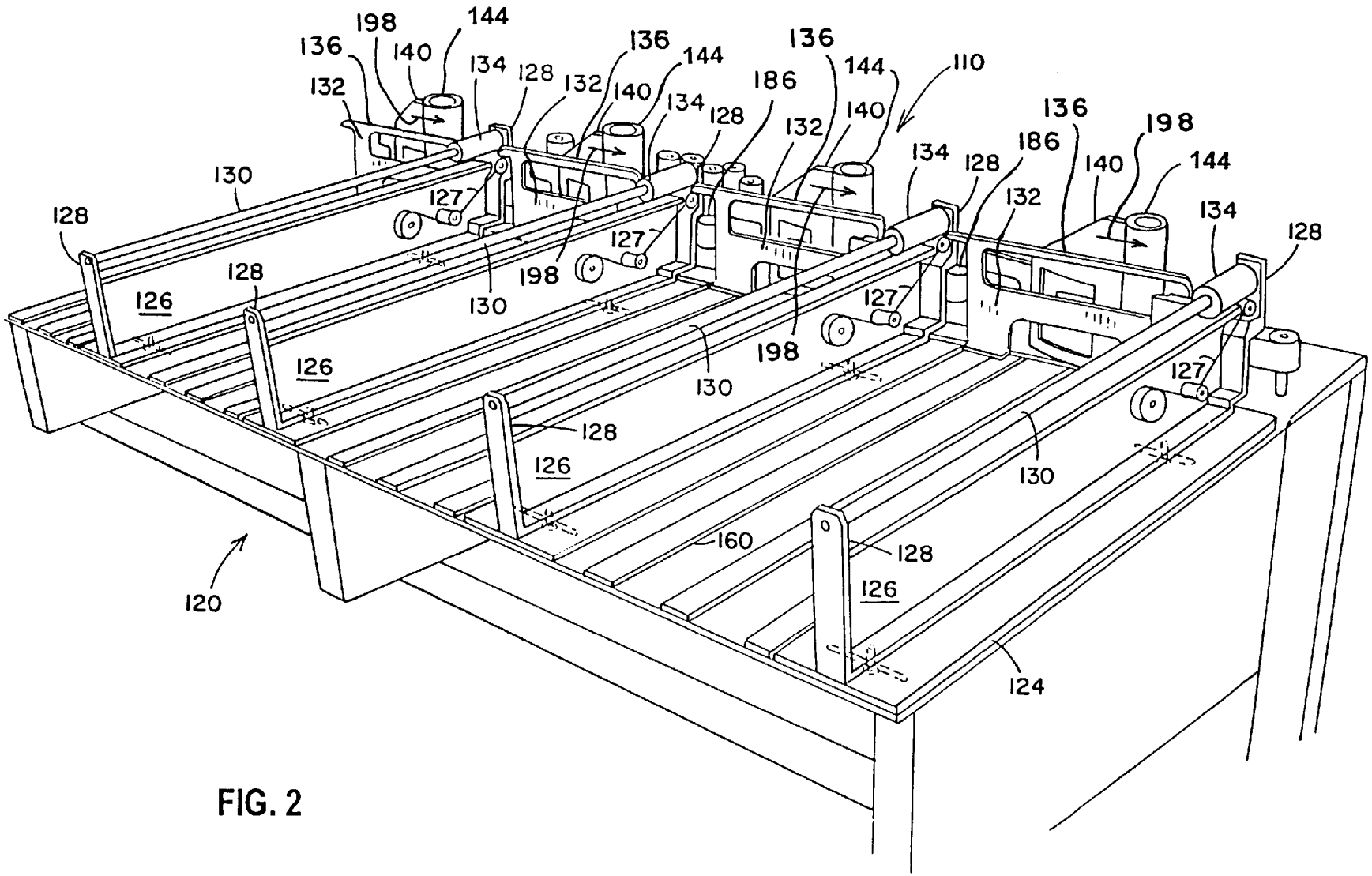
FIG. 2 is a perspective view of the stacking and sorting apparatus in accordance with the present invention.

Referring now to FIGS. 1 and 2, stacker 110 includes a plurality of bins, generally designated 120, and a vertical transport, generally designated 122 (FIG. 1). Bins 120 each include a base plate 124 and a series of opposing registration walls 126 that are fixed and mounted to the base plate 124. Registration walls 126 divide base plate 124 into the separate bin sections 120. In this embodiment of the present invention, there is four separate registration walls 126. Each registration wall 126 is mounted at an interval along base plate 124 to make four separate sorting bins. Each registration wall 126 includes a pair of vertically extending structural end members 128 that are fixed to the base plate 124. Each end member 128 extends above the top of registration wall 126. Also extending above each registration wall 126 is a bar 130 that longitudinally extends above the top of a respective wall 126 of each sorting bin 120. Within each sorting bin 120 the opposing end of a bar 130 extends above the top of a respective registration wall 126. Each opposing end of a bar 130 is mounted to a respective end member 128. Each bin 120 also includes a slidably mounted paddle 132 that is mounted on a respective bar 130. Paddle 132 includes at one end a cylinder-shaped member 134 that is orthogonal to a flat section 136 of paddle 132. Cylinder member 134 includes an aperture through which Paddle 132 is slidably mounted on bar 130. In addition to moving along longitudinally along bar 130, paddle 132 can pivot upwards (not shown) about bar 130 allowing the removal of a stack from a corresponding bin 120. Paddle 132 is preferably spring loaded on bar 130 by means of a spring assembly 127.

Each sorting bin 120 further preferably includes a lead-in guide plate 140 which is functional to guide the mailpieces along a transport path 198 (FIG. 2), which leads to each sorting bin 120. An urge pulley 144 is arranged between an upright guide structure 146 and the lead-in guide plate 140. Each bin 120 also has a pivotable gate 145 which is activated by a signal from a control system (not shown) for the stacker 110. When a respective gate 145 is actuated, it temporarily intersects the transport path 198 defined by the transport 122 to thereby divert an envelope from the transport path 198 into a sorting bin 120.

Figure 3:
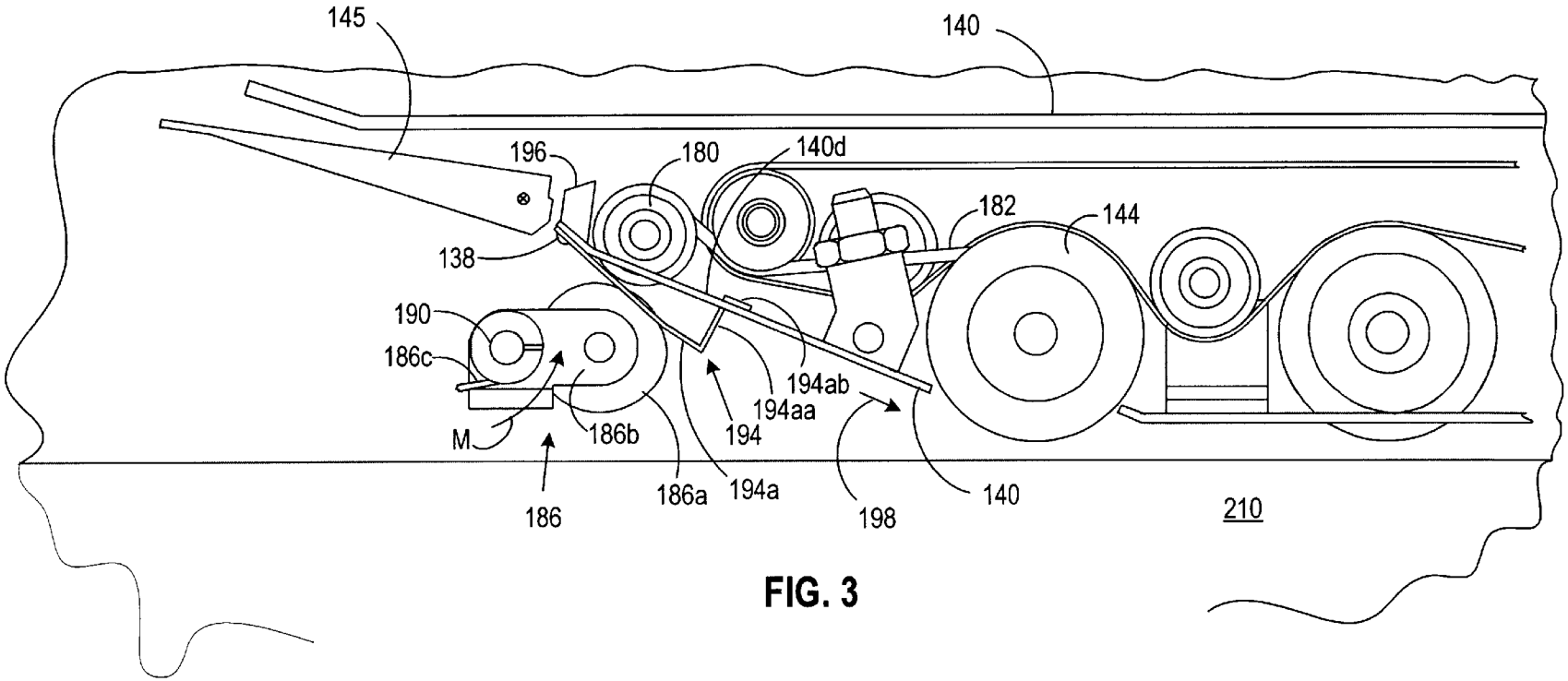
FIG. 3 is a plan view of a portion of the sorter's transport track and associated apparatus for handling mailpieces.
Figure 4:
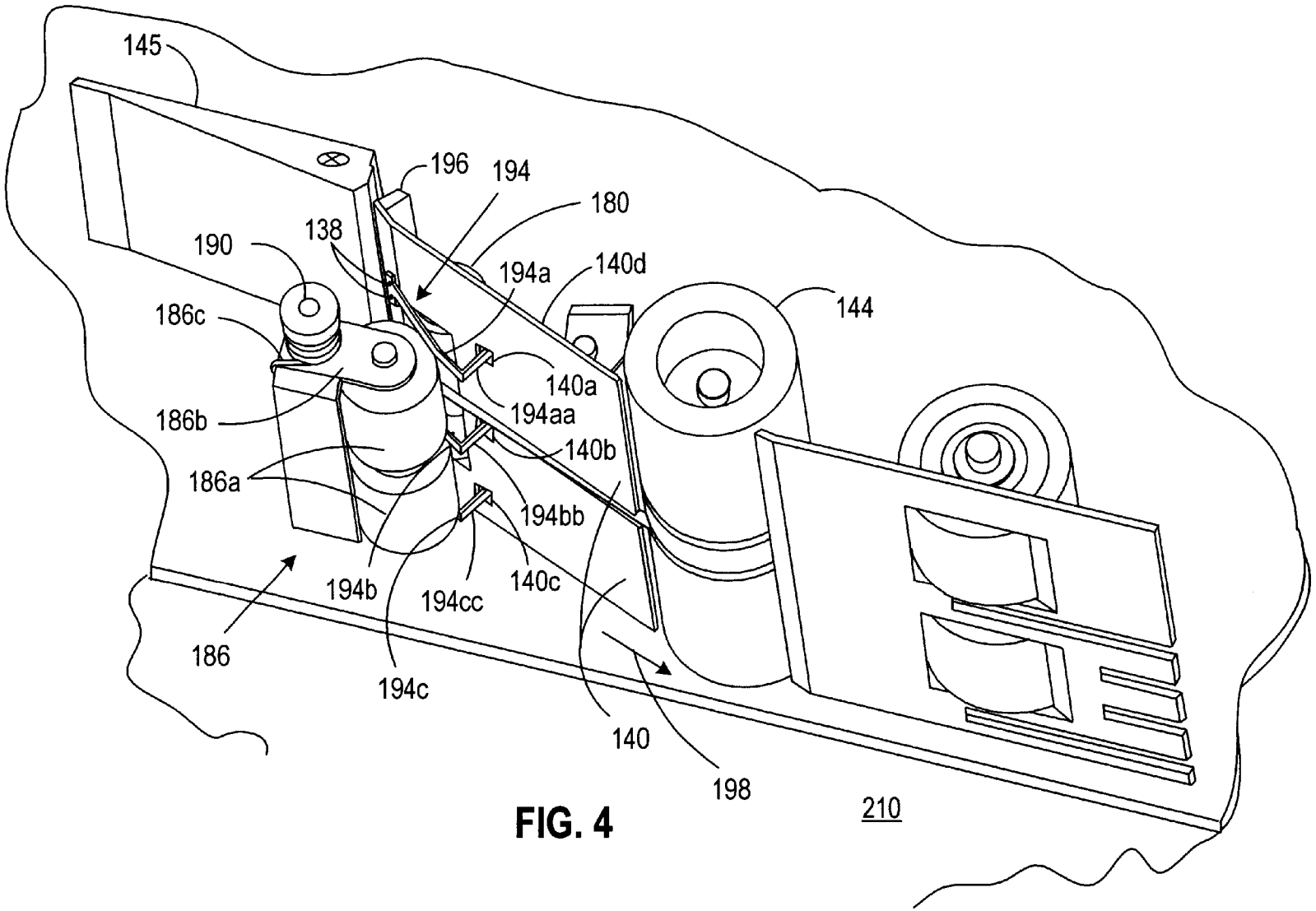
FIG. 4 is an enlarged perspective view of the entrance area to a stacker bin as taken from FIG. 3; the view focusing on the apparatus and area where the mailpieces are transported into the typical stacker bin.

Referring to FIGS. 3 & 4 of the instant invention, there is a driven conveyor roller 180 powered by a belt 182, that is supported and driven by a pulley and motor (not shown) associated with the friction roller 144. There is an idler roller assembly 186 mounted for engagement under spring bias towards the conveyor roller 180. The roller assembly 186 is comprised of a roller 186*a,* and a support arm 186*b,* rotatably supported on a mounting stud 190. A biasing spring 186*c* urges the idler roller assembly 186 in the counter clock wise, (CCW) direction M in order to engage the conveyor roller 180. The roller 186*a* is segmented (FIG. 4) as is familiar in the art, which in the present embodiment of this invention will accept fingers (to be defined later) between the segments of the roller 186*a*. The segmented roller 186*a* may accept variations of fingers in the space as such for example, pressure fingers, guide members, sensing arms, flexure fingers, kicker fingers, kicker flexures (which all will be adaptable to the design). These elements are defined as interlaced components intended to interact with the mailpieces and be operatively deflected as those mailpieces are transported between the roller 180 and the roller 186*a*.

In the embodiment shown in FIG. 3, there is a stack of at least two pressure elements, kicker elements or kicker fingers (from now on referred to as kicker fingers) 194 secured to an upright structural guide member 196. The structural guide member 196 will be understood to be fastened to the base plate 124 of the stacker 110. The stack of kicker fingers 194 as shown includes three kicker fingers 194*a,* 194*b* and 194*c,* (FIG. 4.) all formed from a satisfactorily manufactured metal or plastic part. The kicker fingers 194*a,* 194*b* and 194*c* as shown are all manufactured separately in the form of a leaf spring having appropriate bends and contours that fit the physical parameters of the embodiment shown (see FIG. 4*a*). The kicker fingers 194*a,* 194*b* and 194*c* are all firmly attached to the upright structural member 196, by means of screws 138 and are described in more detail below as is a substitute version that illustrates how the kicker fingers may be made from a unitary piece of material.

Figure 4B:
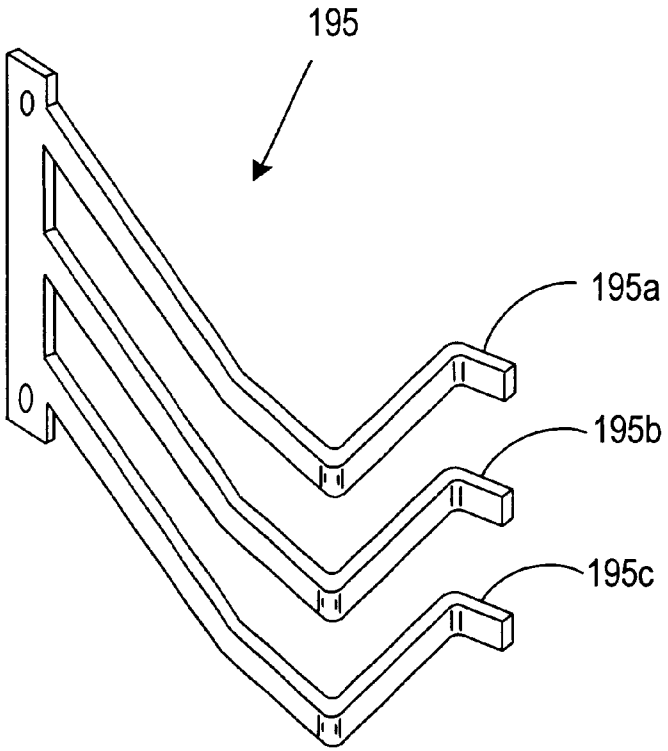
FIG. 4*b* is a view taken along the same lines as FIG. 4*a,* illustrating the kicker-finger elements constructed in a one piece design.

Referring to FIG. 4*b,* the kicker fingers 194*a,* 194*b* and 194*c* may be manufactured from an integral single piece of material 195, so that two or more fingers or kicker fingers are extended from that same part. In FIG. 4*b,* a finger 195*a,* 195*b* and 195*c* will each correspond to the previously defined fingers 194*a,* 194*b,* and 194*c,* with the same finger-like shape and functionality. In the case of implementing a design such as that shown and represented by FIG. 4*b,* care will be taken to design the flexing part of the kicker element to conform with the intended and desired effect of the present invention. For example, the kicker fingers 194*a,* 194*b* and 194*c* when deflected by a mailpiece each typically exert a force of between 75–125 grams against the mailpiece at a nip defined between the roller 180 and conveyor roller assembly 186. The aforementioned is provided for illustrative purposes only as the force that is exerted is to be appropriate for a wide range of mailing envelopes or mailpieces with or without insert material enclosed.

Figure 4A:
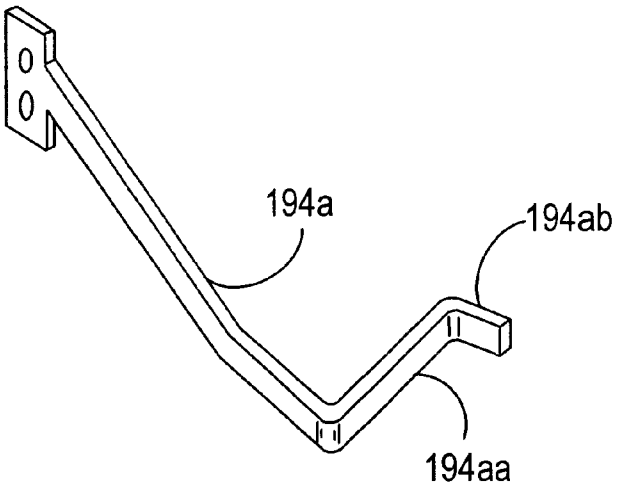
FIG. 4*a* is a view of one of the "kicker finger" elements, showing the detail of its formed shape.

Referring to FIG. 4*a,* each kicker finger 194*a,* 194*b* and 194*c* is shaped with a bent angular leg that forms a substantially right angle portion 194*aa,* 194*bb,* and 194*cc* respectively. The angular legs 194*aa,* 194*bb* and 194*cc* reach towards and protrude through a vertically disposed series of apertures 140*a,* 140*b,* and 140*c* located within the support wall 140. Each kicker element 194*a,* 194*b* and 194*c* all have an additional short leg as shown in FIG. 4*a* as an example leg 194*ab.* The kicker fingers 194*b,* and 194*c* also have a similar short legs (not shown). The short legs 194*ab,* etc. act as stops that rest against a rear surface 140*d* of the support wall 140. The purpose of the relationship between the short legs 194*ab,* etc. is to protect those relatively thin and flexible associated kicker fingers from inadvertent damage caused by an operator in the course of clearing material or mailpieces from the mailpiece feeding path. The stop action of the short leg 194*a*" etc also provides a limit stop against the rear surface 140*d* of the support wall 140. In this way, the kicker fingers 194*a,* 194*b* and 194*c* are pre-loaded because of their free state design. The fingers 194*a,* 194*b* and 194*c* are manufactured with tolerances designed to align vertically with each other in the vertical plane that will engage an oncoming mailpiece. The limit stop design then provides a proper attitude for the leading edge of all mailpieces entering the stacker bin to engage the kicker fingers without the possibility of a jam of a misplaced or deformed element.

Figure 5:
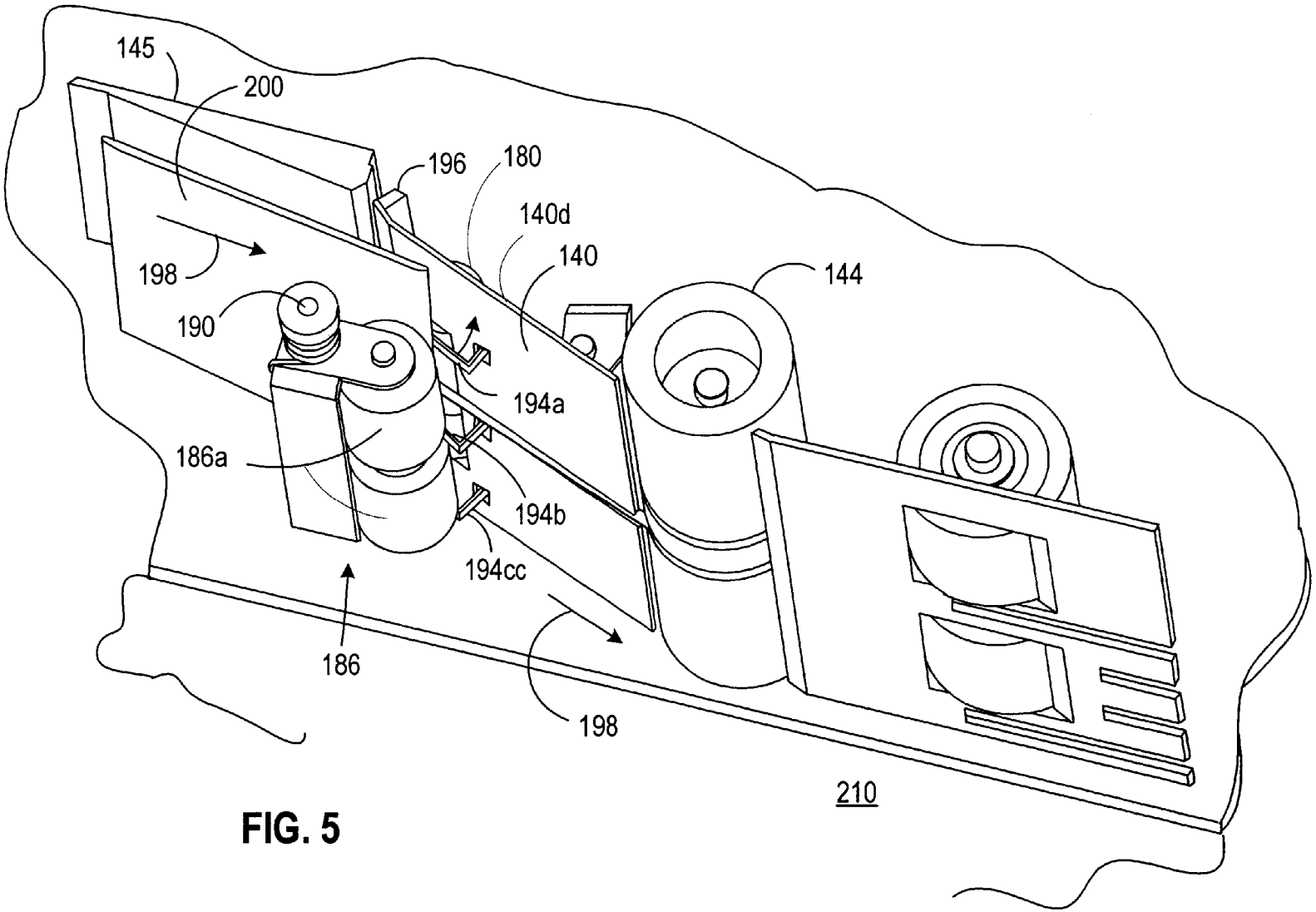
FIG. 5 is a view similar to FIG. 4, showing a mailpiece entering the "kicker" area of the sorter transport, leading to the stacker bin.
Figure 6:
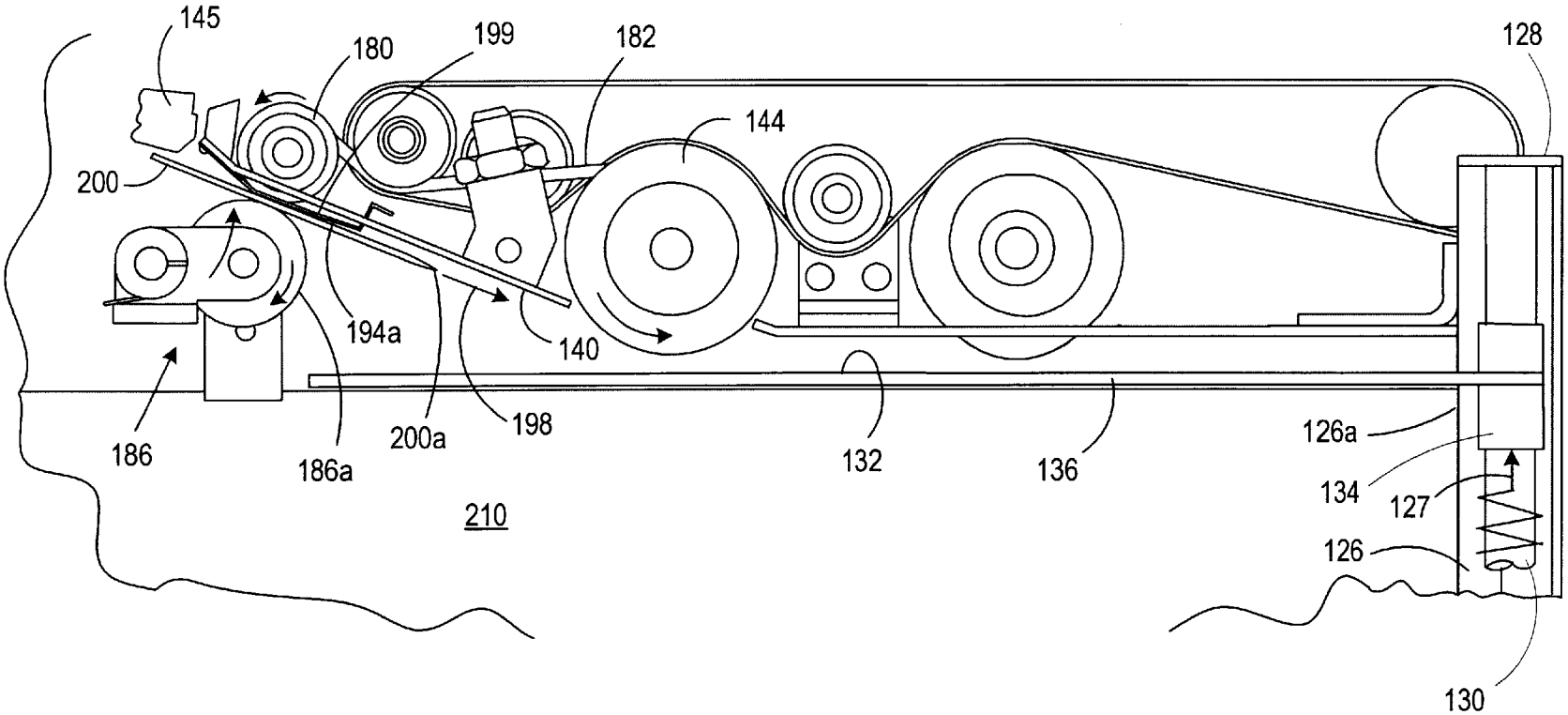
FIG. 6 is a partial plan view similar to FIG. 3, showing a leading end of a mailpiece having deflected the "kicker finger" elements of the present invention to a fully deflected position.

Referring now to FIG. 5, a mailpiece 200 is shown entering along a transport path 198 towards the nip between the idler roller assembly 186 and the driven conveyor roller 180. (The transport path 198 is any path along the sorter that will enter a mailpiece into a sorting bin). The pressure elements 194*a,* 194*b* and 194*c* are being deflected at this time by the presence of the mailpiece 200, and move towards the support wall 140 (FIG. 6). Referring to FIG. 6, the mailpiece 200 is moving through the nip between the conveyor roller 180 and the idler roller 186*a* towards a sorter bin 210. The kicker fingers 194*a,* 194*b* and 194*c* are deflected back by the mailpiece 200 so that they are oriented close to the support wall 140. The deflection of the kicker fingers 194*a,* 194*b* and 194*c* will typically be to a tangent point defined as a fully deflected position 199. Position 199 for the mailpiece 200 may also be defined (FIG. 6*a* as being) tangent with the outside diameter of the roller 180. The mailpiece 200 is pushing the kicker fingers 194*a,* 194*b* and 194*c* towards the support wall 140, and this tangent point or deflected position 199 is the limit of the deflection regardless of the weight of the mailpiece. The full deflection to the deflected position 199 is designed to provide sufficient force from the kicker fingers 194*a,* 194*b* and 194*c* to spring the trailing end of each mailpiece towards the roller 186*a.* This action is accentuated by the outside feeding periphery of the roller 186*a.* Roller 186*a* will then carry or urge the trailing end of the mailpiece 200 and force it towards the stacker paddle 132. This occurs once a leading end 200*a* of the mailpiece 200 strikes the registration wall 126 of the particular sorting bin (in this case bin 210) of the sorting bins 120 referred to earlier in this specification.

Figure 7:
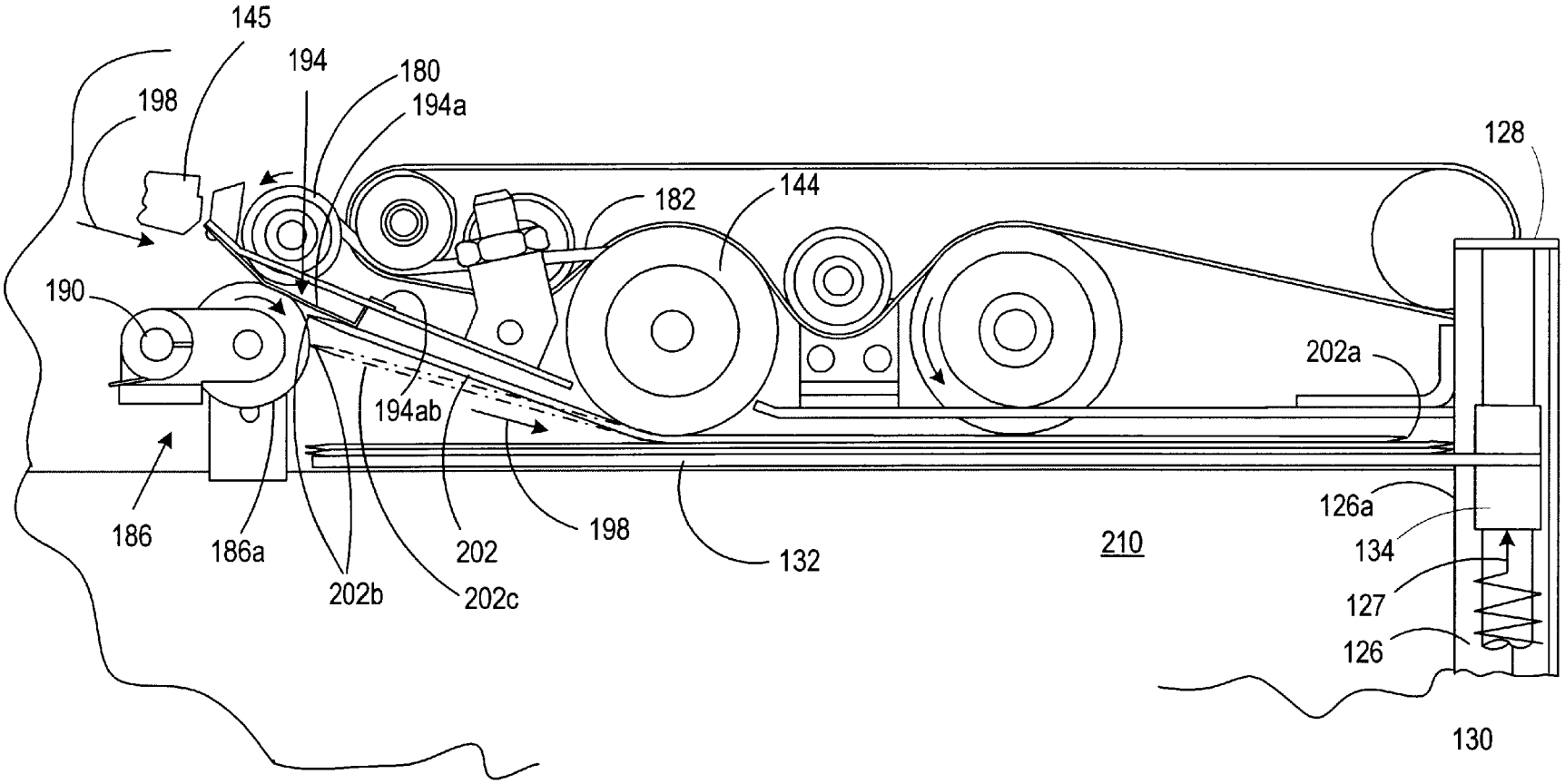
FIG. 7 is a partial plan view similar to FIG. 6, showing the mailpiece moving towards the stacker support and stacker bin wall while the "kicker finger" is beginning to push the trailing end of the mailpiece towards the stacker paddle.

With reference to FIG. 7, a second mailpiece 202 is shown moving along the transport path 198. A leading end 202*a* of the mailpiece 202 is nearing or close to abutting a surface 126*a* of the registration wall 126 in the sorting bin 210. A second position 202*c* of the mailpiece 202 is seen with a trailing end 202*b* of the mailpiece 202 being forced towards the roller 186*a* by the kicker fingers 194*a,* 194*b* and 194*c.* The second position 202*c* demonstrates that the trailing end 202*b* is abutting the rotating roller 186*a,* and as such is being forced into the desired position that is generally flat against the paddle 132 as is desired to make a compact stack of mail.

Figure 8A:
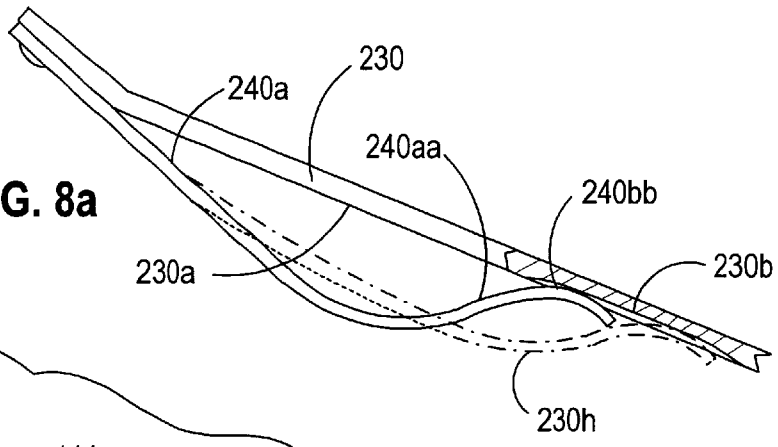
FIG. 8 is a perspective view similar to FIG. 4, showing an alternate embodiment of the present invention; and, FIG. 8*a* is a partial section view taken from FIG. 8 showing a detail of a depressed area in the mailpiece guiding wall; the depressed area providing protection for the machine operator and for the kicker fingers on the stacker support wall.
Figure 8:
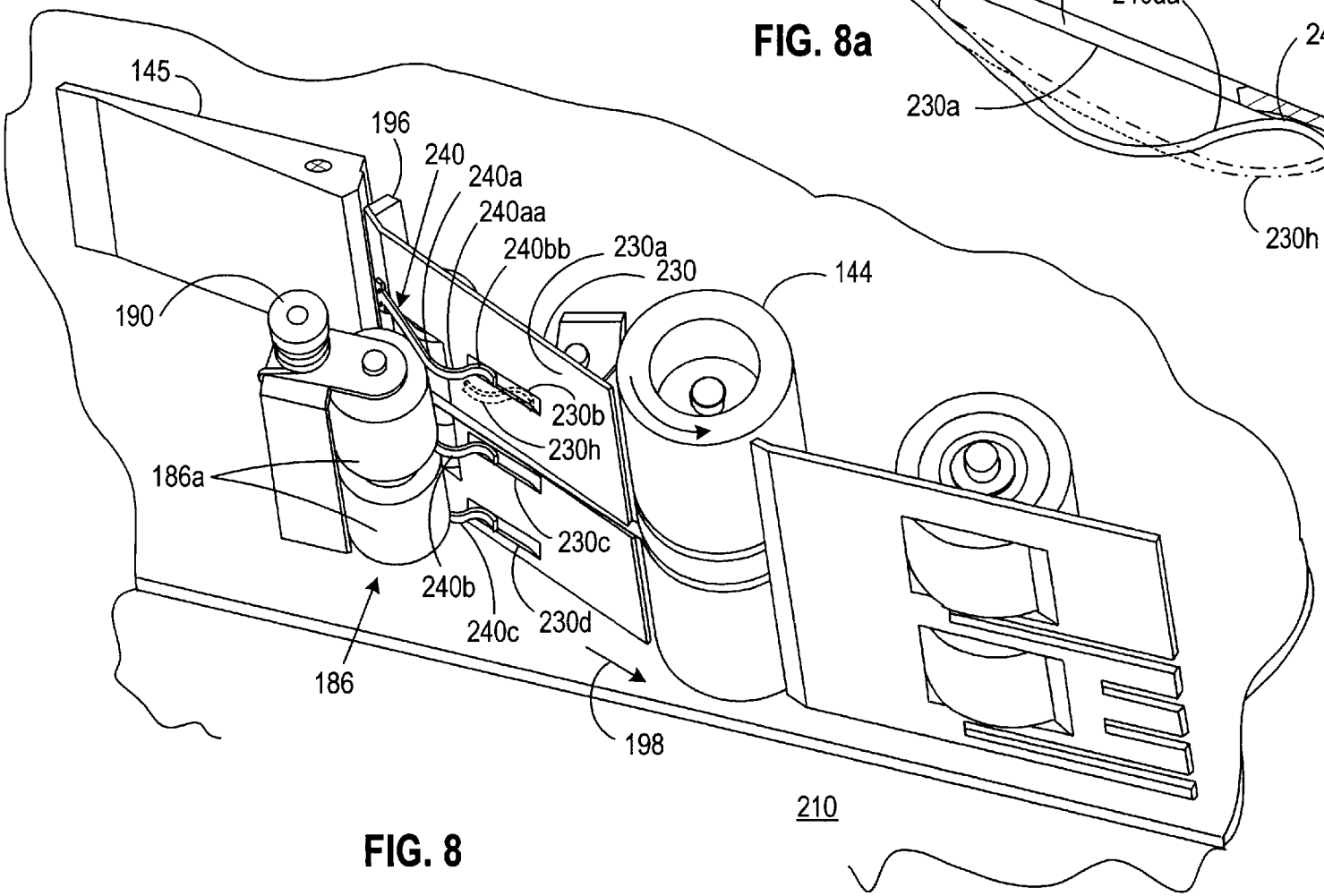

Referring now to FIG. 8, there is an alternate embodiment of the present invention. FIG. 8 is taken along the same lines as FIG. 3, however the kicker fingers in this embodiment are applied to the apparatus somewhat differently. In this embodiment, a support wall 230 is shown, (in the same attitude as the prior support wall 140 described) however there are a vertical series of depressed surfaces 230*b,* 230*c* and 230*d* in a face 230*a* of the support wall 230. There is a stack of kicker fingers 240, that are mounted and manufactured the same as that previously described in the prior embodiment with some difference in the shape at the ends that engage the mailpieces. There is a kicker element 240*a,* 240*b* and 240*c,* all secured to the support wall 196 as previously described with reference to the kicker fingers 194*a,* 194*b* and 194*c.* Each kicker element 240*a,* 240*b* and 240*c* have a spring-like shape defined and shown in FIG. 8*a.* In FIG. 8*a* for example in reference to element 240*a,* there is a bent and curved leg 240*aa* (FIG. 8*a*) that has a foot 240*bb* which rides in the depressed surface 230*a,* as do the remainder of the extension feet of the kicker element 240*b,* and 240*c* in a respective depressed surface 230*c* and 230*d* of the support wall 230.

The kicker fingers 240*a,* 240*b* and 240*c* all react in the same manner as the prior embodiment employing kicker fingers 194*a,* 194*b* and 194*c* in that they become depressed upon engagement with an oncoming mailpiece heading into the sorter bin. The foot 240*bb* and other similarly shaped feet of the kicker fingers 240*a,* 240*b* and 240*c* in their recesses are protected from inadvertent or unintentional distortion by a machine operator. In interaction with each mailpiece entering the sorting bin 210, the kicker finger 240*a,* 240*b* and 240*c* are deflected by each mailpiece, and flatten slightly as depicted in FIG. 8*a* (i.e. position 230*h*). The foot 240*bb* slides along the depressions 230*b* to a deflected position 230*h,* which will finally kick the trailing end of the mailpiece that leaves the nip of the conveyor roller 180 and idler roller assembly 186. (reference is made to the prior embodiment and the stream of mailpieces entering the stacker bin 210). Meanwhile, the depression 230*b,* 230*c,* and 230*d* are all protecting the foot 240*bb* and other similar feet of the kicker fingers 240*b* and 240*c* as they slide back and forth within the depressions upon deflection of the kicker finger 240*a* and so forth. The kicker fingers 240*a,* 240*b* and 240*c* are all manufactured of either a plastic or suitable metal with an inertial cross section that is compatible to deliver a desired force upon the mailpiece trailing end (as previously described).

While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. A sorting apparatus for sorting mailpieces into at least one stacking compartment, the sorter having a transport apparatus for conveying the mailpieces along a transport path in the sorter, and a gate mechanism selectively operative in one of two modes; a first mode for diverting a mailpiece to a first stacking compartment and a second mode to permit additional mailpieces to continue along the transport path towards other stacking compartments; wherein the at least one stacking compartment comprises;

a transport frame having a series of upright structural guide members associated with each of the stacking compartments;

a driving nip located adjacent to the gate mechanism; the driving nip formed by a drive roller and a biased pivotable link holding an idler roller;

a mailpiece registration wall at an end directly opposed to the driving nip, and;

a stack of at least two spaced apart kicker fingers that are interposed with the idler roller; each of the kicker fingers being fixedly anchored to an upright structural guide member such that each of the kicker fingers are interfaced with the structural guide member through a corresponding stack of receiving apertures located in a wall of the structural guide member.

2. A sorter as recited in claim 1 wherein each kicker finger is formed from a flexible material.

3. A sorter as recited in claim 2 wherein each kicker finger is formed from spring steel.

4. A sorter as recited in claim 2 wherein each kicker finger is formed from plastic.

5. A sorter as recited in claim 4 wherein each kicker finger is formed from polypropylene.

6. A sorter as recited in claim 1 wherein each of the kicker fingers have a bent extension that is interposed with the structural guide member and a further extension of the kicker fingers that interfaces with a rear wall of the structural guide member thereby locating and trapping each of the kicker fingers at a rest position.

7. A sorting apparatus for sorting mailpieces into at least one stacking compartment, the sorter having a transport apparatus for conveying the mailpieces along a transport path in the sorter, and a gate mechanism selectively operative in one of two modes; a first mode for diverting a mailpiece to a first stacking compartment and a second mode to permit additional mailpieces to continue along the transport path towards other stacking compartments; wherein the at least one stacking compartment comprises;

a substantially horizontal transport frame having a series of substantially vertical structural guide members between each of the stacking compartments;

a driving nip located adjacent to the gate mechanism, the driving nip formed by a drive roller and a biased pivotable link holding an idler roller;

a mailpiece registration wall at an end directly opposed to the driving nip, and;

a unitary member formed to include a parallel series of spaced apart kicker fingers that are interposed with the idler roller; the unitary member being fixedly anchored to an upright structural guide member such that each of the kicker fingers are interfaced with the structural guide member with an extension on each kicker finger that reaches through a corresponding spaced apart number of receiving apertures located in a wall of the structural guide member.

8. A method of sorting mailpieces into at least one stacking compartment, the sorter having a transport apparatus for conveying the mailpieces along a transport path in the sorter, and a gate mechanism selectively operative in one of two modes; a first mode for diverting a mailpiece to a first stacking compartment and a second mode to permit additional mailpieces to continue along the transport path towards other stacking compartments; wherein the method comprises;

feeding mailpieces along the transport path;

diverting a mailpiece through a feed nip comprised of a fixed feed roller and a yieldable-segmented kicker roller;

deflecting at least a kicker finger of a stack of kicker fingers interposed with the feed nip and the yieldable segmented kicker roller from a first position interlaced with the yieldable segmented kicker roller to a second position whereby the kicker finger or the stack of kicker fingers are deflected by a mailpiece to a point lying substantially tangent to the feed nip, and;

stopping a leading edge of the mailpiece against a registration wall located within the stacking compartment while a kicker finger or the deflected stack of kicker fingers push the trailing end of the mailpiece towards engagement with a downstream side of the segmented kicker roller so as to further push the mailpiece against a movable paddle associated with the stacker compartment.

9. A sorting apparatus for sorting mailpieces into at least one stacking compartment, the sorter having a transport apparatus for conveying the mailpieces along a transport path in the sorter, and a gate mechanism selectively operative in one of two modes; a first mode for diverting a mailpiece to a first stacking compartment and a second mode to permit additional mailpieces to continue along the transport path towards other stacking compartments; wherein the at least one stacking compartment comprises;

a transport frame having a series of structural guide members between each of the stacking compartments;

a driving nip formed by a drive roller and a biased pivotable link holding an idler roller;

a mailpiece registration wall at an end directly opposed to the driving nip, the stacking assembly further having a paddle for biasing the mailpieces towards the transport path, and;

a stack of at least two spaced apart kicker fingers that are interposed with the idler roller; each kicker finger being fixedly anchored to an upright structural guide member such that each of the kicker fingers are interfaced and in contact with the structural guide member through a corresponding parallel series of receiving depressions formed in a wall of the structural guide member.

10. A sorting apparatus as recited in claim 9 wherein the transport frame is substantially horizontal, and the series of structural guide members are substantially vertical along with the driving nip between the drive roller and the idler roller.

11. A sorting apparatus for sorting mailpieces into at least one stacking compartment, the sorter having a transport apparatus for conveying the mailpieces along a transport path in the sorter, and a gate mechanism selectively operative in one of two modes; a first mode for diverting a mailpiece to a first stacking compartment and a second mode to permit additional mailpieces to continue along the transport path towards other stacking compartments; wherein the at least one stacking compartment comprises;

a transport frame having a series of structural guide members between each of the stacking compartments;

a driving nip formed by a drive roller and a biased pivotable link holding an idler roller;

a mailpiece registration wall at an end directly opposed to the driving nip, the stacking assembly further having a paddle for biasing the mailpieces towards the transport path, and;

a stack of at least two kicker fingers that are arranged in parallel relationship such that each of the kicker fingers is interposed with the idler roller; each of the kicker fingers further being fixedly anchored to an upright structural guide member and further being interfaced with the structural guide member through a corresponding stack of receiving apertures or relieved depressions located in a wall of the structural guide member.

12. A sorting apparatus for sorting mailpieces as recited in claim 11 wherein each of the kicker fingers is formed of a resilient metal.

13. A sorting apparatus for sorting mailpieces as recited in claim 12 wherein each of the kicker fingers is formed of beryllium copper.

14. A sorting apparatus for sorting mailpieces as recited in claim 11 wherein each of the kicker fingers is formed of a resilient plastic.

15. A sorting apparatus for sorting mailpieces as recited in claim 14 wherein each kicker finger is formed of polypropylene.

16. A sorting apparatus for sorting mailpieces as recited in claim 11 wherein each of the kicker fingers is formed of spring steel.

* * * * *